US005491844A

United States Patent [19]

Kehl et al.

[11] Patent Number: 5,491,844

[45] Date of Patent: Feb. 20, 1996

[54] DISPOSABLE BIB ASSEMBLY AND METHOD OF PACKAGING

[75] Inventors: Gary R. Kehl, Sandy, Utah; John L. Sigalos, Dallas, Tex.

[73] Assignee: DenNap, Inc., Murray, Utah

[21] Appl. No.: 198,447

[22] Filed: Feb. 18, 1994

Related U.S. Application Data

[63] Continuation-in-part of Ser. No. 973,628, Nov. 9, 1992, abandoned.

[51] Int. Cl.[6] ..... A41B 13/00; A41B 13/10

[52] U.S. Cl. ..... 2/49.1; 2/49.4; 2/49.5; 2/243.1

[58] Field of Search ..... 2/46, 48, 49.1, 2/49.2, 50, 49.3, 49.4, 49.5, 51, 52, 114, 104, 105, 80, 75, 69; 206/820, 390, 499; 428/40, 79

[56] References Cited

U.S. PATENT DOCUMENTS

| | | | |
|---|---|---|---|
| 1,896,253 | 2/1933 | Smith . | |
| 2,440,666 | 4/1948 | Miller . | |
| 2,528,602 | 1/1950 | Magit . | |
| 2,763,867 | 9/1956 | Chagnon . | |
| 2,902,734 | 9/1959 | Walters . | |
| 3,196,511 | 7/1965 | Kintner . | |
| 3,328,807 | 9/1967 | Strauss . | |
| 3,332,547 | 7/1967 | Rowe et al. . | |
| 3,488,773 | 1/1970 | Stemmer . | |
| 3,685,643 | 8/1972 | Garshelis . | |
| 3,695,269 | 10/1972 | Malaney | 128/284 |
| 3,979,776 | 9/1976 | Gruenwald . | |
| 4,306,316 | 12/1981 | Klepfer . | |
| 4,423,523 | 1/1984 | Bodner . | |
| 4,660,225 | 4/1987 | Kahn . | |
| 4,660,226 | 4/1987 | Quilling et al. . | |
| 4,980,927 | 1/1991 | Wawiluk et al. . | |
| 5,230,944 | 7/1993 | Beer et al. | 428/40 |
| 5,270,088 | 12/1993 | Grasse | 428/40 |

OTHER PUBLICATIONS

A Copy of the Translation of the Neumayer Reference, DE 3207,883.

*Primary Examiner*—Jeanette E. Chapman
*Attorney, Agent, or Firm*—John L. Sigalos

[57] ABSTRACT

A bib panel for covering the chest and part of the neck of a dental patent is made of bonded composite liquid impervious and treated liquid absorbent material, is generally rectangular in form and has a circular cut-out for the patient's neck. A strip of adhesive extends across the top edge of the back of the panel. The adhesive is a pressure sensitive adhesive and has the property that it can be attached to the front of another bib panel and then removed without contaminating the adhesive. A plurality of bib panels are stacked and attached together to form a pad of panels for dispensing the panels by peeling the top panel from the one below it. The plurality of panels are attached to a support back or, placed in a disposing tray, the bottom panel adhering to the support back or the bottom of the dispensing tray.

15 Claims, 2 Drawing Sheets

DISPOSABLE BIB ASSEMBLY AND METHOD OF PACKAGING

CROSS REFERENCE TO RELATED APPLICATION

This application is a continuation-in-part of U.S. application Ser. No. 07/973,628, filed Nov. 9, 1992, now abandoned entitled Disposable Bib Assembly and Method of Packaging, whose entire specification and claims are specifically incorporated herein by reference.

BACKGROUND OF THE INVENTION

This invention relates to bibs used to cover the shoulders and upper chest during dental procedures, and more particularly to the bib and method of applying adhesive, and packaging the bib for ease of use and to prevent contamination of the adhesive on the bib.

Disposable bibs used during dental procedures have been made of various plastic and cloth materials, and are attached by chains around the neck, or by adhesive areas that are temporarily attached to clothing under the bib. The adhesive areas used in attaching bibs have to be covered by a pull tab to prevent contamination of the adhesive prior to the use of the bib. Such a bib is disclosed in U.S. Pat. No. 3,488,773. In this patent, a bib is illustrated having three adhesive areas, each of which is covered with a tab that covers the adhesive area until the bib is to be used. The tabs are removed and the bib attached to the clothing of the person having dental procedures. The application of pull tabs over multiple adhesive areas adds to the cost of manufacture. Since the bibs are used only one time, it is desirable to manufacture a bib at the lowest cost. The limited adhesive areas do not have good adherence to rough textured clothing, and having only a small adhesive area at the corners of the bib allows the bib to wrinkle or bow open at the top, allowing water or other fluids used or generated during the dental procedures to drop behind the bib onto the clothing.

Another prior art proposal is that of German Offenlegungsschrift No. DE 3207883 A, granted to W. Meumayer. According to the Meumayer patent, there is proposed a disposable baby's bib, which can be provided singly or on a block from which individual bibs may be torn off. The back of the bib is said to be either impregnated or coated with a waterproof layer, and the bib is said to include ties or fastenings for the neck. It also is said to include an adhesive piece for clinging to the clothing of the baby.

Yet another proposal is that set forth in U.S. Pat. No. 4,306,316, granted Dec. 22, 1981, to Harlan A. Klepfer. According to the proposals of the Klepfer patent, there is provided a disposable bib, napkin, or apron of flexible sheet material having a neck cut out and including in the upper portion a pressure sensitive adhesive capable of releasedly adhering to itself and to the clothing or body of a user. In order to protect such adhesive, it is taught that the garment is folded upon itself prior to use with one portion of the adhesive contacting and overlying another portion thereof whereby the entire area of adhesive is covered by the garment itself.

While the prior art proposals have addressed the importance of protecting the person and/or clothing of a user in certain circumstances, there nevertheless has continued to be the need for providing a bib structure that is particularly addressed to conditions existing during certain medical and dental procedures as well as to render protective bibs convenient in packaging, readily accessible, effective in their protection and modest in cost. Accordingly, there has continued to be felt the need for further improvements.

SUMMARY OF THE INVENTION

The invention is to a disposable bib assembly comprising a plurality of bibs removably attached to a support with each bib having a large adhesive area for better adherence to clothing, and to a bib assembly structured such that each bib is releasably adhered to the bib immediately below it.

The assembly includes, in one embodiment, individual bibs releasably adhered to each other with the lowermost bib mounted on a base that can be placed on a wall or other surface, and individual bibs readily detached from the assembly as needed. The adhesive extends across the top of the bib except at the cut-out portion that fits around the neck of the wearer. The bibs are packaged so that each bib adheres to the bib below it, the lower bib preventing contamination of the adhesive on the bib. Since the bibs are of a material that will not permit a liquid to pass therethrough, such as treated cloth, paper or a plastic, the adhering of the upper bib to the lower bib does not contaminate the adhesive. It is preferred to use a plastic material although coated paper or otherwise treated so as to prevent liquid from penetrating the bib is also suitable. Any commercially available pressure-sensitive adhesive may be used so long as it may originally be adhered to another bib, removed, and then adhered to, for example, clothing. Pull tabs over the adhesive areas are not needed.

Although as mentioned above, any commercially available pressure-sensitive adhesive having certain characteristics may be employed while practicing the principles of the invention, it has been discovered that acrylic pressure sensitive adhesives are especially attractive. Moreover, by bonding together a very thin plastic sheet of hydrophobic material such as polyethylene and a very thin sheet of surfactant-treated polypropylene material, a much improved composite sheet is produced, a sheet that is particularly adapted for practice of the invention hereof.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT OF THE INVENTION

Figure 1:
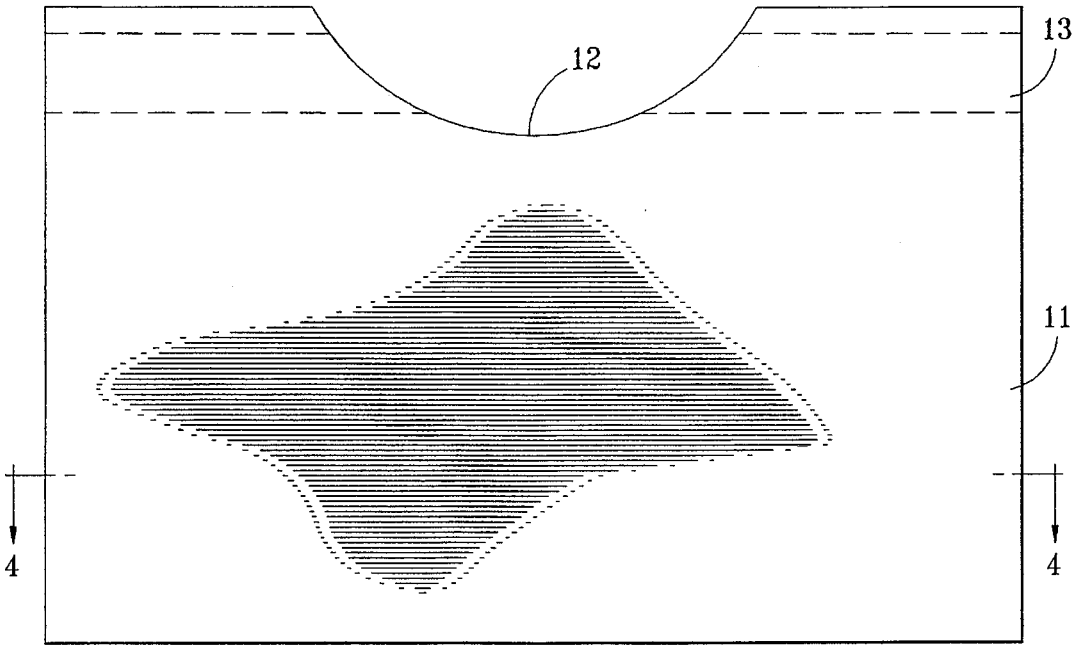
FIG. 1 is a bib used in the present invention.

FIG. 1 illustrates an individual bib 11 of the bib assembly of the present invention. Bib 11 is a panel of a flexible material such as a treated cloth or paper or a plastic, as long as it is fluid repellant. Panel 11 may be a single layer of material or may have several layers of plastic and absorbent materials. One of several commercially available pressure sensitive adhesives 13 is applied across the top of the panel to provide a large adhesive area so that the panel does not gap open at the top allowing contaminants such as saliva, water, or dental fluids to drop behind the panel onto the clothing of the wearer.

As mentioned above, although any of several commercially available pressure sensitive adhesives can be employed while practicing the principles of the inventions hereof, it has been found that a conventional medium-tack acrylic adhesive such as used in making removable and repositionable double face tapes is particularly efficacious. Such an adhesive is commercially available from 3M Company as Acrylic A-40 adhesive.

It is, in fact, desirable to use a double coated film tape, such as those conventionally made and sold by the 3M Company. Such film tapes are coated on one side with a high-tack (permanent) pressure sensitive adhesive and on the other side with a medium-tack (removable) pressure sensitive adhesive. After it has been secured to the portion of bib panel 11 with the high-tack adhesive the protective release liner is removed and the exposed face of the medium-tack adhesive will then adhere to the bib panel 11 below it.

A neck opening 12 is cut in the top of the panel 11 to permit the panel to fit close to, and around the neck. Adhesive 13 extends from the edge of the neck opening to the outer edges of the panel 12.

Figure 2:
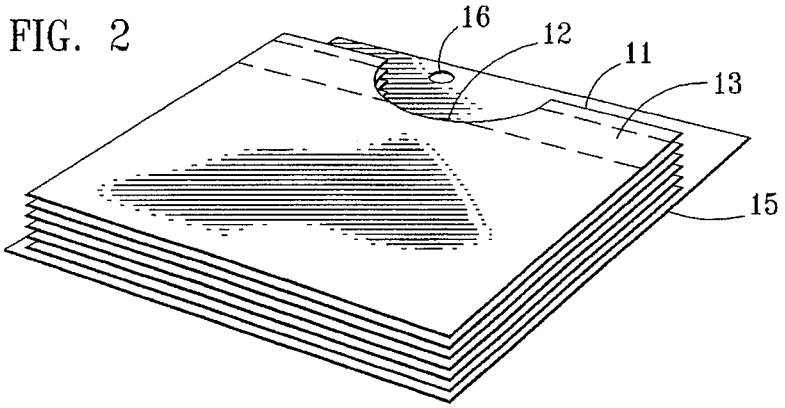
FIG. 2 illustrates a bib assembly.

FIG. 2 illustrates an assembly of the present invention comprising a plurality of individual bib panels 11 on a support surface 15. Each bib 11 is attached to the panel below it by a pressure sensitive adhesive 13. Since each panel is of a plastic or coated material, the adhesive will hold the panels together in a pad allowing the top panel to be removed by peeling the top panel from the one immediately below it. The adhesive on the back of the panel is not contaminated, and the adhesive will adhere to the clothing of the wearer. Since the adhesive extends across the top of the panel, the large area of adhesive will secure adherence to most clothing.

The bib panels 11 are mounted on a mounting board 15 such that the board may be placed on a flat surface, or attached to a wall by a screw or nail through opening 16. The overall weight of the panels and backing board permits the easy removal of a bib panel with one hand. Since pull tabs are not required or used over the adhesive, the bib is ready for use after it is removed from the assembly of stacked bibs.

Figure 3:
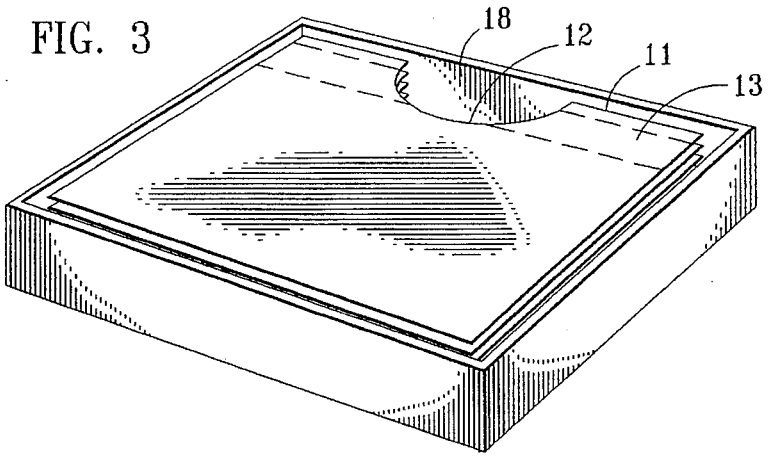
FIG. 3 illustrates a bib assembly in a dispenser.

The bib panels may be packaged in a reusable plastic tray such that a package of panels may be inserted in the tray for use, the last panel, and adhesive thereon, holding the package of panels in place. FIG. 3 illustrates the packaged bibs in a tray 18. Tray 18 is similar to a tray used to hold note pads or similar items.

Figure 4:
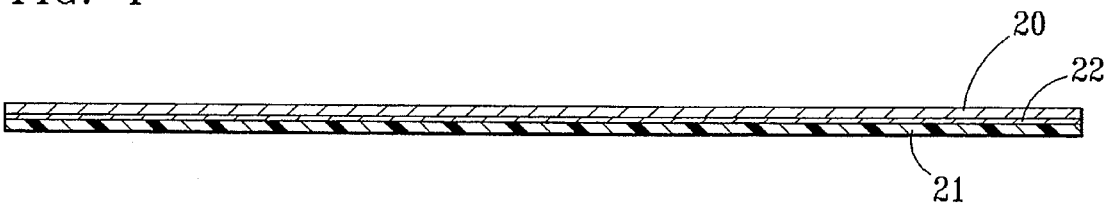
FIG. 4 is a view illustrating the bonded composite structure of the bib material according to the invention.

FIG. 4 is a section taken along section lines 4—4 of FIG. 1 and illustrating the bonded layer construction of the bib according to the invention. There, in FIG. 4, are seen upper liquid absorbent sheet 20 which is bonded to lower liquid impervious sheet 21 along their contiguous surfaces represented by bonding line 22. Such bonded composite material is available from Poly-Bond Incorporated of Charlottesville, Va.

While a range of material thickness may satisfactorily be employed in practicing the principles of the invention hereof, it will be recognized that in accordance the preferred embodiment the thicknesses of such sheets be no greater than that required to provide the desired characteristics of liquid absorption, liquid imperviousness, and reasonable durability. It has been found that a one mil thick microembossed polyethylene material bonded to a one mil thick sheet of polypropylene provides the preferred characteristics as previously mentioned.

Figure 5:
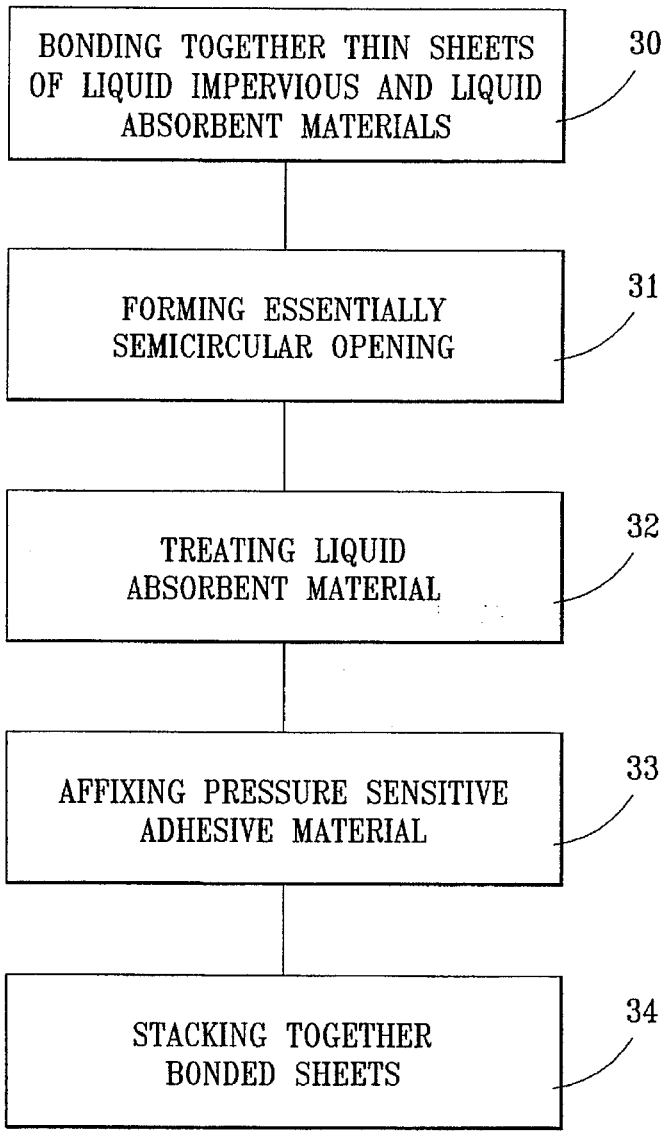
FIG. 5 is a flow diagram illustrating steps in a method of practicing the invention hereof.

Now turning to FIG. 5, it will be observed that the preferred method for practicing the invention is illustrated therein. The aforementioned sheets are bonded together as represented by step 30 after which the aforementioned semicircular opening preferably is formed therein as represented by step 31. Then the liquid absorbent material is treated with any conventional surfactant known to increase liquid absorbency as represented by step 32. Next, pressure sensitive adhesive material or double face tape is applied as described above and represented by step 33, after which individual bibs comprising the bonded sheets are stacked together as represented by step 34.

It will be evident to those skilled in the art from a consideration of the steps illustrated in FIG. 5 that the order in which they are conducted is not critical. Thus, for example, the liquid absorbent sheet could be treated prior to its bonding with the liquid impervious sheet, or formation of the semicircular openings could be performed on the individual sheets prior to their being bonded together.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A bib assembly of a plurality of bibs in stacked form for covering the neck and chest areas of a person during dental and medical procedures, comprising:

(a) a plurality of rectangular panels, each having first and second parallel sides joined by top and bottom sides and having front and back sides, each said panel comprising a sheet composite of:

(i) a thin liquid impervious sheet and (ii) a thin liquid absorbent sheet bonded to said liquid impervious sheet;

(b) an essentially semicircular opening in said top side of each said panel for fitting partially around the wearer's neck; and (c) a pressure sensitive adhesive material on the backside of each panel adhering each panel to the panel immediately below it, said adhesive having properties that permit attaching and removing from a wearer's clothing without leaving residue on said clothing, said adhesive extending across the top side of said panel from said first side to said circular opening, and from said second side to said circular opening.

2. A bib assembly according to claim 1 in which said liquid impervious sheet comprises a thin sheet of polyethylene.

3. A bib assembly according to claim 1 in which said liquid absorbent sheet comprises a thin sheet of polypropylene.

4. A bib assembly according to claim 1 in which said liquid impervious sheet comprises a thin sheet of polyethylene and said liquid absorbent sheet comprises a thin sheet of treated polypropylene.

5. A bib assembly according to claim 1 in which said liquid absorbent sheet includes a surfactant.

6. A bib assembly according to claim 1 further including a liquid dispensing agent applied to said liquid absorbent sheet.

7. A bib assembly according to claim 1 in which said pressure sensitive adhesive material comprises a medium-tack acrylic adhesive.

8. A bib assembly according to claim 7 in which said pressure sensitive material comprises an elongated strip having two principal sides, said medium tack adhesive being disposed on one of said two principal sides and wherein a high-tack adhesive is disposed on the other of said two principal sides.

9. A bib assembly according to claim 4 in which said liquid absorbent sheet includes a liquid dispersing agent.

10. A bib assembly according to claim 9 in which said pressure sensitive adhesive material comprises a medium-tack acrylic adhesive.

11. A bib assembly according to claim 10 in which said liquid dispersing agent is a surfactant.

12. A bib assembly of a plurality of bibs in stacked form for covering the neck and chest areas of a person during dental and medical procedures, comprising:

(a) a plurality of rectangular panels, each having first and second parallel sides joined by top and bottom sides and having front and back sides, each said panel comprising a sheet composite of:

(i) a thin polyethylene sheet; and (ii) a thin polypropylene sheet bonded to said polyethylene sheet and including a surfactant applied thereto;

(b) an essentially semicircular opening in said top side of each said panel for fitting partially around the wearer's neck; and (c) a pressure sensitive adhesive material on the backside of each panel adhering each panel to the panel immediately below it, said adhesive having properties that permit attaching and removing from a wearer's clothing without leaving a residue on said clothing, said adhesive extending across the top side of said panel from said first side to said circular opening, and from said second side to said circular opening.

13. A bib assembly according to claim 12 in which said pressure sensitive adhesive material comprises an elongated strip having two principal sides, wherein a medium-tack adhesive is disposed on one of said two principal sides and a high-tack adhesive is disposed on the other of said two principal sides.

14. A method of making a bib assembly of a plurality of bibs in stacked form for covering the neck and chest areas of a person during dental and medical procedures, comprising steps of:

(a) selecting a thin sheet of polyethylene;

(b) selecting a thin sheet of polypropylene;

(c) bonding said thin sheet of polyethylene to said thin sheet of polypropylene thereby to form a composite sheet;

(d) treating said thin sheet of polypropylene with a surfactant;

(e) forming a partially circular opening in one end of said composite sheet thereby to form a bib;

(f) applying a pressure sensitive adhesive material to the backside of each bib; and (g) stacking each said bib together to form a stack of said bibs.

15. A method of making a bib assembly according to claim 14 wherein said step of applying a pressure sensitive adhesive material comprises steps of:

(a) selecting an elongates strip of pliable material having two principal surface areas on opposite sides thereof;

(b) disposing on one of said principal surface areas a medium-tack adhesive; and (c) disposing on the other of said principal surface areas a high-tack adhesive.

* * * * *